US009518525B2

(12) United States Patent
Zukouski

(10) Patent No.: US 9,518,525 B2
(45) Date of Patent: Dec. 13, 2016

(54) SYSTEM AND METHOD OF CONTROLLING FUEL INJECTION PRESSURE IN AN ENGINE HAVING AN IN-CYLINDER PRESSURE SENSOR

(75) Inventor: Russell P. Zukouski, Bolingbrook, IL (US)

(73) Assignee: International Engine Intellectual Property Company, LLC., Lisle, IL (US)

( * ) Notice: Subject to any disclaimer, the term of this patent is extended or adjusted under 35 U.S.C. 154(b) by 14 days.

(21) Appl. No.: 14/407,341

(22) PCT Filed: Jun. 11, 2012

(86) PCT No.: PCT/US2012/041817

§ 371 (c)(1),
(2), (4) Date: Dec. 11, 2014

(87) PCT Pub. No.: WO2013/187856

PCT Pub. Date: Dec. 19, 2013

(65) Prior Publication Data

US 2015/0122223 A1 May 7, 2015

(51) Int. Cl.

| | |
|---|---|
| ***F02D 41/30*** | (2006.01) |
| ***F02D 41/38*** | (2006.01) |
| ***F02D 35/02*** | (2006.01) |
| ***F02D 15/04*** | (2006.01) |
| ***F02D 41/00*** | (2006.01) |
| *F02D 41/14* | (2006.01) |

(52) U.S. Cl.

CPC ..... *F02D 41/30* (2013.01); *F02D 15/04* (2013.01); *F02D 35/023* (2013.01); *F02D 41/0002* (2013.01); *F02D 41/14* (2013.01); *F02D 41/3836* (2013.01); *F02D 41/1454* (2013.01); *F02D 2200/0602* (2013.01); *F02D 2250/31* (2013.01); *F02D 2250/36* (2013.01)

(58) Field of Classification Search

CPC ..... F02D 41/30; F02D 15/04; F02D 41/0002; F02D 41/14; F02D 15/00; F02D 15/02; F02D 41/38; F02D 41/3809; F02D 41/3827; F02D 41/3836; F02D 2250/31; F02D 35/023

See application file for complete search history.

(56) References Cited

U.S. PATENT DOCUMENTS

| | | | | |
|---|---|---|---|---|
| 6,988,029 | B1 | 1/2006 | Kennedy | |
| 7,702,449 | B2 | 4/2010 | Rodriguez | |
| 2010/0242900 | A1 * | 9/2010 | Hitomi | F02D 35/023 123/299 |
| 2012/0130622 | A1 * | 5/2012 | Yamada | F02D 35/024 701/104 |

* cited by examiner

*Primary Examiner* — Jacob Amick

(74) *Attorney, Agent, or Firm* — Jack D. Nimz; Jeffrey P. Calfa

(57) ABSTRACT

A method of operating an internal combustion engine is provided. An in-cylinder pressure within a cylinder of the engine is determined. A fuel injection pressure from a fuel injector disposed within the cylinder is determined. A ratio of the in-cylinder pressure within the cylinder and the fuel injection pressure is compared to a stored threshold value. The fuel injection pressure is adjusted based upon the comparison of the ratio of the in-cylinder pressure within the cylinder and the fuel injection pressure to the stored threshold value.

1 Claim, 2 Drawing Sheets

SYSTEM AND METHOD OF CONTROLLING FUEL INJECTION PRESSURE IN AN ENGINE HAVING AN IN-CYLINDER PRESSURE SENSOR

TECHNICAL FIELD

The present disclosure relates to a system and method of controlling combustion within an internal combustion engine having a variety of sensors for monitoring combustion occurring within a cylinder, such that adjustments may be made to operating parameters of the internal combustion engine. The adjustments of the operating parameters allow combustion to function properly, while also allowing emissions of the engine to meet government mandates.

BACKGROUND

Many modern diesel engines have an exhaust system that features an exhaust gas recirculation ("EGR") system that routes a portion of engine exhaust gas into an air intake system, such that a mixture of fresh air and engine exhaust is supplied to a combustion chamber during engine operation. In order to reduce certain pollutants found in exhaust gas of an internal combustion engine, such as NOx and particulate matter, several approaches have been tried, including using an after-treatment chemical in conjunction with a catalytic converter, a system often referred to as a selective catalyst reduction system or an "SCR system." An SCR system adds complexity to an engine, and requires a catalyst that must be periodically replenished, which increases operating costs. If the catalyst is not replenished, the engine exhaust typically will not meet emissions standards, and the engine may be required to cease operations.

Therefore, a need exists for an engine capable of meeting emissions standards without the use of an after-treatment system to control parameters useful in reducing emissions of the engine.

SUMMARY

According to one process, a method of operating an internal combustion engine is provided. An in-cylinder pressure within a cylinder of the engine is determined A fuel injection pressure from a fuel injector disposed within the cylinder is determined A ratio of the in-cylinder pressure within the cylinder and the fuel injection pressure is compared to a stored threshold value. The fuel injection pressure is adjusted based upon the comparison of the ratio of the in-cylinder pressure within the cylinder and the fuel injection pressure to the stored threshold value.

According to another process, a method of operating an internal combustion engine is provided. An air/fuel ratio of an internal combustion engine is determined At least one of fuel injection quantity and intake air flow is adjusted to provide an air/fuel ratio between about 15 and about 18. An in-cylinder pressure within a cylinder of the engine is determined A fuel injection pressure from a fuel injector disposed within the cylinder is determined A compression ratio of the engine is adjusted based upon a comparison of a ratio of the in-cylinder pressure within the cylinder and the fuel injection pressure to a predetermined stored threshold value.

DETAILED DESCRIPTION

Figure 1:
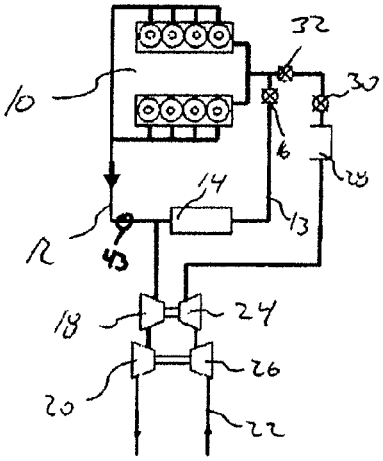
FIG. 1 is a schematic diagram showing an engine.

FIG. 1 shows an engine 10 having an exhaust system 12. The exhaust system 12 has an exhaust gas recirculation ("EGR") portion 13. The EGR portion 13 has an EGR cooler 14 and an EGR valve 16. The EGR cooler 14 reduces the temperature of exhaust gas within the EGR portion 13. The exhaust system 12 additionally is shown as having a first turbocharger turbine 18 and a second turbocharger turbine 20. The EGR valve 16 controls the flow of exhaust gas within the EGR portion 13.

The engine 10 additionally has an air intake system 22. The air intake system 22 has a first turbocharger compressor 24 and a second turbocharger compressor 26. A charge air cooler 28 is additionally provided to cool intake air within the air intake system 22. A first throttle valve 30 and a second throttle valve 32 are also disposed within the air intake system 22. The first turbocharger turbine 18 and the first turbocharger compressor 24 form a first turbocharger and the second turbocharger turbine 20 and the second turbocharger compressor 26 form a second turbocharger. It is contemplated that the first turbocharger and the second turbocharger may be variable geometry turbochargers.

Figure 2:
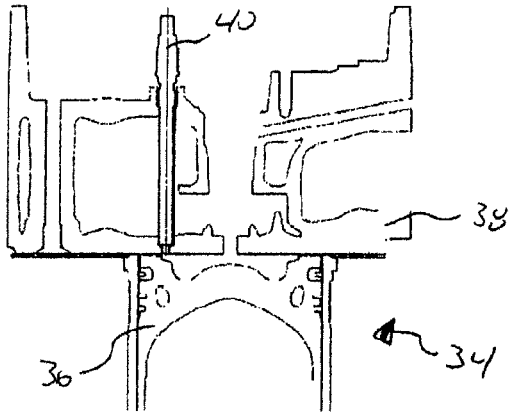
FIG. 2 is a sectional view of an engine showing a cylinder having an in-cylinder pressure sensor.

Turning now to FIG. 2, a cross section of a cylinder 34 of the engine 10. The cylinder 34 has a piston 36 that moves reciprocally within the cylinder 34. A cylinder head 38 is disposed above the cylinder 34, such that the movement of the piston 36 within the cylinder 34 increases a pressure within the cylinder 34. An in-cylinder pressure sensor 40 is additionally provided. The in-cylinder pressure sensor 40 is disposed within the cylinder head 38 and a portion of the in-cylinder pressure sensor 40 is exposed within the cylinder 34. The in-cylinder pressure sensor 40 monitors the pressure within the cylinder 34. In a multi-cylinder engine 10, there are multiple sensors 40 forming a sensor group 41.

Figure 3:
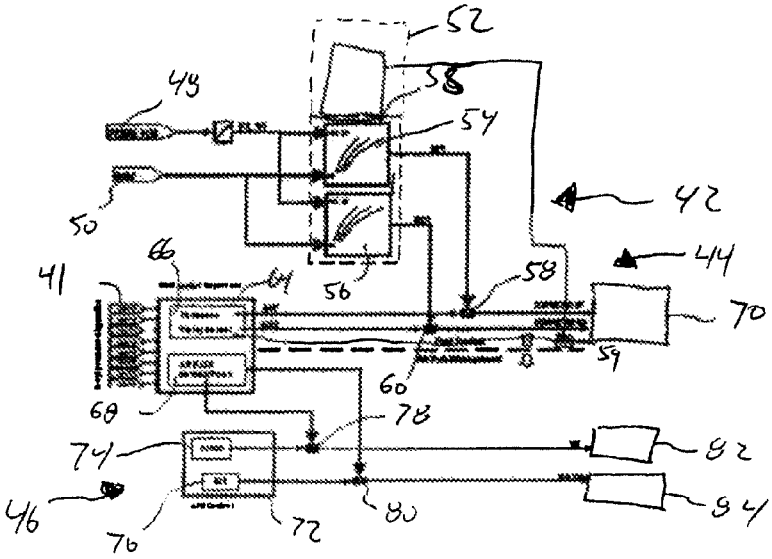
FIG. 3 is block diagram showing a control system for an engine having an in-cylinder pressure sensor.

FIG. 3 depicts a block diagram for a control system 42 for the engine 10, while FIGS. 6*a* and 6*b* depict a flow chart of a method of controlling the engine 10. The control system 42 has a fuel system control component 44 and an air system control component 46. The fuel system control component 44 has an accelerator position sensor 48 and an engine speed sensor 50. The accelerator position sensor 48 and the engine speed sensor 50 are in electrical communication with a fuel system controller 52.

The fuel system controller 52 has a memory that stores fuel injection quantity data 54, fuel injection pressure data 55 as well as fuel injection timing data 56, wherein both data 54, 56 are graphically represented with curves. The fuel injection pressure data 55 is variable, and is dependent at least in part on the in-cylinder pressure data from the group 41 of in-cylinder pressure sensors 40. For instance, the fuel injection pressure data 55 may vary proportionally with the in-cylinder pressure observed by the in-cylinder pressure sensors 40. For instance, as in-cylinder pressure increases, fuel injection pressure may also increase. The increased fuel injection pressure allows fuel injected into the cylinder 34 with a high in-cylinder pressure to penetrate to locations proximate walls of the cylinder 34, thereby utilizing oxygen disposed within areas of the cylinder 34 not previously used for combustion. Similarly, when in-cylinder pressure is low, fuel injection pressure may be lowered to prevent an excess amount of fuel from contacting walls of the cylinder 34

Based upon the input received from the accelerator position sensor 48 and the engine speed sensor 50, the fuel system controller 52 retrieves a fuel injection quantity output from the fuel injection quantity data 54, retrieves a fuel injection pressure output 55, and also retrieves a fuel injection timing output from the fuel injection timing data 56. The fuel injection quantity output is communicated to a fuel injection quantity comparator 58, the fuel injection pressure output is communicated to a fuel injection pressure comparator 59, while the fuel injection timing output is communicated to a fuel injection timing comparator 60.

The fuel system control component 44 additionally utilizes the group 41 of in-cylinder pressure sensors 40 that communicate with a combustion monitoring processor 64 that contains a fuel system memory 66 containing fuel injection timing correction data, fuel injection pressure correction data, and fuel injection quantity correction data based upon the output of the group 41 of in-cylinder pressure sensors 40. Outputs of the fuel system memory 66 is electronically communicated to the fuel injection quantity comparator 58, the fuel injection pressure comparator 59, and the fuel injection timing comparator 60. The fuel injection quantity comparator 58 compares the output of the fuel injection quantity data 54 with the output from the fuel system memory 66 of the combustion monitoring processor 64 to generate a corrected fuel injection quantity communicated to a fuel injector 70. The fuel injection pressure comparator 59 compares the output of the fuel injection pressure data 55 with the output from the fuel system memory 66 of the combustion monitoring processor 64 to generate a corrected fuel injection pressure communicated to a fuel injector 70. Similarly, the fuel injection timing comparator 60 compares the output of the fuel injection timing data 56 with the output from the fuel system memory 66 of the combustion monitoring processor 64 to generate a corrected fuel injection timing communicated to a fuel injector 70.

The air system control component 44 of the control system 42 for the engine 10 additionally utilizes the group 41 of in-cylinder pressure sensors 40 that communicate with the combustion monitoring processor 64 that has an air intake system memory 68. An air intake system controller 72 has a memory that stores turbocharger data 74 as well as EGR system data 76. The air intake system controller 72 retrieves a turbocharger setting from the turbocharger data 74 based upon engine operating conditions. The air intake system controller 72 additionally retrieves an EGR valve setting from the EGR system data 76. Output of the turbocharger data 74 and the air intake system memory 68 is transmitted to a turbocharger comparator 78 which compares the turbocharger data 74 with the output of the air intake system memory 68 and may adjust the turbocharger setting output using the turbocharger data 74 to generate a corrected turbocharger setting to a turbocharger 82.

The EGR system data 76 from the air intake system controller 72 is transmitted to an EGR system comparator 80 where the EGR system comparator 80 compares it to the output of the air intake system memory 68 and may adjust the EGR setting output using the EGR system data 76 to generate a corrected EGR system setting to an EGR valve 84.

Figure 4:
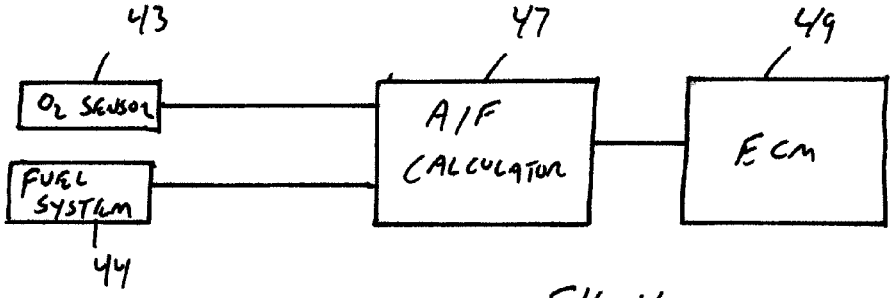
FIG. 4 is a block diagram showing an air/fuel ratio calculator.

Controlling combustion of fuel within the cylinder 34 requires a number of additional sensors. For instance, an oxygen sensor 43 may be provided. As shown in FIG. 1, the oxygen sensor 43 is disposed within the exhaust system 12 of the engine 10. However, it is contemplated that the oxygen sensor 43 may alternatively be placed in the air intake system 22. The oxygen sensor 43 allows a concentration of oxygen within the cylinder 34 during combustion to be calculated. Further, based on a percent of EGR being provided from the EGR portion 13 to the engine 10 for combustion, a total amount of oxygen available for combustion may be determined FIG. 4 shows a method of calculating an air/fuel ratio. A fuel system 44 on the engine 10 provides information to an air/fuel ratio calculator 47 regarding an amount of fuel injected into the cylinder 34 during a combustion cycle. The air/fuel ratio calculator 46 also receives an input from the oxygen sensor 43. Thus, based on the output of the oxygen sensor 42 and the fuel system 44, the air/fuel ratio calculator 47 determines the air/fuel ratio of the engine 10. The air/fuel ratio calculator 47 communicates with an electronic control module ECM 49. The ECM 49 has a memory containing prestored data relating to air/fuel ratio for various engine operating conditions, that may be an function of engine speed, engine power output, engine operating state, temperature, altitude, air pressure, and the like.

A variety of approaches may be utilized to adjust fuel injection pressure. For instance, in a common-rail fuel system, a pressure relief valve may be provided at an outlet of the common-rail in order to reduce the pressure of the fuel injection. Similarly, a pressure relief valve may be provided at each injector, or in a fluid line in fluid communication with a fuel injector, so that fuel pressure at the injector is reduced. In a unit injector, a length of travel of a piston may be adjusted to vary the pressure of fuel injected by the injector. Such an variable piston travel may be implemented by a variable profile cam surface. Similarly, a piston-type fuel pump may have a variable cam surface to modify the length of travel of the piston used to pressurize the fuel that is fed to injectors to vary the injection pressure.

Additionally, it is contemplated that adjustments can be made to diameters of flow paths within fuel injectors to modify the pressure of fuel leaving the injector. For instance, the diameter of the flow path may be reduced in order to increase pressure, or the diameter of the flow path may be increased to reduce the pressure of fuel injected into the cylinder.

Further, in addition to adjusting the diameter of the flow path within a fuel injector, it is also contemplated that relief valves may be provided on each injector to reduce the injection pressure below its maximum value. The pressure relief valve could be electronically actuated to allow a portion of the fuel passing through the injector to drain back to a fuel tank of a vehicle.

Balancing the ratio between fuel injection pressure and in-cylinder pressure is beneficial in obtaining atomization of fuel within the cylinder 34. Proper atomization of the fuel allows more of the oxygen available within the cylinder to be utilized, thereby allowing higher rates of EGR to be used during combustion to reduce the formation of $NO_x$ during combustion. Controlling fuel injection pressure also allows more accurate control of the timing of combustion of fuel, allowing the temperature generated by combustion of fuel to be more accurately controlled.

In addition to balancing the fuel injection pressure with the in-cylinder pressure, it is also contemplated that a droplet size of fuel being injected into the cylinder 36 may also be adjusted. Fuel droplet size may be partially controlled based upon injection pressure of the fuel exiting the injector. It is also contemplated that fuel droplet size may be controlled by controlling an aperture of the fuel injector to adjust fuel droplet size. For instance, a larger aperture will generate a larger droplet, while a smaller aperture will result in a smaller droplet. Further, it is contemplated that a fuel injector could have multiple sets of openings, a first set to deliver small fuel droplets and a second set to deliver large fuel droplets.

It is contemplated that such a variable fuel droplet size concept would be utilized in connection with an engine operating with an air/fuel ratio between about 15 and about 18. An air/fuel ratio calculator receives an input from the oxygen sensor and a fuel system. Thus, based on the output of the oxygen sensor and the fuel system, the air/fuel ratio calculator determines the air/fuel ratio of the engine 10. The air/fuel ratio calculator communicates with an electronic control module (ECM). The ECM has a memory containing prestored data relating to air/fuel ratio for various engine operating conditions, that may be an function of engine speed, engine power output, engine operating state, temperature, altitude, air pressure, and the like. Based upon the prestored data, at least one of the fuel injection quantity and intake air flow is adjusted to generate an air/fuel ratio within the desired range.

A method of operating an internal combustion engine that adjusts the droplet size f fuel provided by a fuel injector would initially determine an air/fuel ratio as described above. At least one of the fuel injection quantity and intake air flow provided to the engine is adjusted to provide an air/fuel ratio of between about 15 and about 18. The compression ratio of the engine is determined The droplet size of fuel provided by the fuel injector is adjusted based upon the compression ratio within the engine.

According to another embodiment, a method of operating an internal combustion engine that adjusts the droplet size of fuel provided by a fuel injector would initially determine an air/fuel ratio as described above. At least one of the fuel injection quantity and intake air flow provided to the engine is adjusted to provide an air/fuel ratio of between about 15 and about 18. An in-cylinder pressure within a cylinder of the engine is determined The droplet size of fuel provided by the fuel injector is adjusted based upon the in-cylinder pressure within the cylinder of the engine.

What is claimed is:

1. A method of operating an internal combustion engine having a plurality of cylinders, comprising:

providing a pressure sensor within a cylinder of the engine for generating a signal representative of the pressure within the cylinder in which the pressure sensor is disposed;

providing a fuel injector in communication with the cylinder having variable injection pressure capability;

determining a fuel injection pressure of a fuel injector disposed within the cylinder and generating a signal representative of the fuel injection pressure;

a fuel injector controller operatively connected with the pressure sensor and fuel injector for receiving the signals from the pressure sensor representative of the pressure within the cylinder and for receiving the signals representative of the fuel injection pressure:

the fuel injector controller configured to perform a calculation of the ratio of the in-cylinder pressure signals and the fuel injection pressure signals;

providing a database of stored threshold values of the ratio of the in-cylinder pressure signals to fuel injection pressure signals;

the fuel injection controller also configured to operate the injector to inject fuel into the cylinder at a predetermined fuel injection pressure based on a stored threshold value;

the fuel injection controller also configured to compare the ratio of the in-cylinder pressure and the fuel injection pressure; and the fuel injector controller adjusting the fuel injection pressure based upon the comparison of the ratio of the in-cylinder pressure within the cylinder and the fuel injection pressure to the stored threshold value.

* * * * *